United States Patent [19]

Moritoki et al.

[11] Patent Number: 4,503,319

[45] Date of Patent: Mar. 5, 1985

[54] HEATER FOR HOT ISOSTATIC PRESSING APPARATUS

[75] Inventors: Masato Moritoki, Miki; Takao Fujikawa, Kobe; Kazuo Kitagawa, Kobe; Junichi Miyanaga, Kobe, all of Japan

[73] Assignee: Kabushiki Kaisha Kobe Seiko Sho, Kobe, Japan

[21] Appl. No.: 443,566

[22] Filed: Nov. 22, 1982

[30] Foreign Application Priority Data

Nov. 20, 1981 [JP] Japan ..... 56-173869[U]
May 17, 1982 [JP] Japan ..... 57-083874

[51] Int. Cl.[3] ..... H05B 3/06; F27B 5/14; F27D 11/02

[52] U.S. Cl. ..... 219/390; 219/553; 219/541; 338/294; 373/117; 373/128; 373/134

[58] Field of Search ..... 219/390, 400, 411, 553, 219/541; 373/110, 111, 114, 117, 119, 125, 128, 132, 134; 338/294, 283–293

[56] References Cited

U.S. PATENT DOCUMENTS

| | | | |
|---|---|---|---|
| 1,669,039 | 5/1928 | Brach | 219/521 |
| 2,497,146 | 2/1950 | Warren | 219/521 |
| 2,966,537 | 12/1960 | Witucki | 373/132 |
| 3,395,241 | 7/1968 | Roman | 219/390 |
| 4,126,757 | 11/1978 | Smith | 373/134 |
| 4;151,400 | 4/1979 | Smith | 219/400 |
| 4,249,032 | 2/1981 | Smith | 373/117 |
| 4,410,796 | 10/1983 | Wilsey | 219/541 |

*Primary Examiner*—Roy N. Envall, Jr.
*Assistant Examiner*—Teresa J. Walberg
*Attorney, Agent, or Firm*—Oblon, Fisher, Spivak, McClelland & Maier

[57] ABSTRACT

A heater for use in the HIP apparatus for treating a work item or work items in a high temperature and pressure gas atmosphere by isostatic application of pressure in a heated condition, the heater including at least one heater assembly unit including a meandering heating element arranged into a cylindrical grid-like form having axial slits open alternately at the upper and lower ends thereof; a plurality of radial projections of a predetermined width extending radially outward from the upper ends of the meandering heating element at a number of predetermined positions including terminal ends thereof; a number of mounted holes formed through the radial extensions of the heating element; a number of support columns fixedly erected respectively on retaining members and having a male screw portion at the upper ends thereof respectively protruded upwardly through the mounting holes in the radial extensions of the heating element; and a number of nuts respectively threaded and tightened on the protruded ends of the male screw portions of the support columns to thereby support in suspended state the heating element securely on the support columns, forming a cylindrical space therein.

6 Claims, 13 Drawing Figures

HEATER FOR HOT ISOSTATIC PRESSING APPARATUS

BACKGROUND OF THE INVENTION

1. Field of the Invention

This invention relates to a heater construction particularly suitable for use in hot isostatic pressing apparatus, and more specifically to a heater of a compact construction which can ensure uniform heating in vertical direction in a high temperature environment involving vigorous free convections and which is easy to assemble.

2. Description of the Prior Art

Recently, ceramic materials such as silicon carbide, silicon nitride and so-called Sialon have attracted attention for application to the heat-resistant high-strength component parts like turbine blades of hot gas turbine engines, nozzles and heat exchangers, while boron carbide is regarded as an excellent friction resistant material. In order to solve the problems which lie in the way to application of these ceramic materials as engineering ceramics, there have thus far been developed high density sintering methods for realizing the inherent properties of these materials and methods for enhancing reliability by reducing irregularities. The hot isostatic pressing (hereinafter referred to simply as "HIP" for brevity) which is employed in the processes of fabrication of cemented carbide parts for sintering a work item at a high temperature and in an isostatically pressed state by using an inert gas as a pressurizing medium is regarded as the most prospective process. However, in order to apply the HIP process to the engineering ceramics for high densification sintering to thereby obtain products of high reliability, it is necessary to employ a temperature above 1700° C. for silicon nitride and Sialon, a temperature above 1850° C. for silicon carbide and a temperature above 2000° C. for boron carbide even in a high pressure gas atmosphere of 1000 kgf/cm$^2$. The hot isostatic pressing apparatus (hereinafter referred to simply as "HIP apparatus" for brevity) which can maintain such a high temperature stably along with uniform heating is still in the stage of development.

The heater, including the above-mentioned HIP apparatus, which is essential to the generation of a high temperature above 1700° C. employs in most cases a heating element of high melting point metal such as molybdenum, tantalum and tungsten or graphite. However, this type of heater which uses a high melting point metal invariably suffers from the problems of creep deformation which occurs during use over a long time period and the coarsening of crystal grains due to repeated thermal cycles, causing embrittled fracture at low temperatures, in addition to an economical problem in that it is extremely costly and unsuitable for a large apparatus. Although graphite can solve these problems, it is barely usable in a large apparatus due to the difficulty of reducing the sectional area of the heating element and the necessity for cooling the joint portions to the metal electrodes during use because of its extremely high heat conductivity.

These are not exceptions even in the HIP apparatus. With the recent developments in the research of the graphite type heater, it has become possible to construct an electric heater which is capable of generating high temperature above 2000° C., further increasing the opportunities for practical applications of the HIP apparatus.

The conventional HIP apparatus is usually provided in its furnace chamber with a cylindrical heater which is, as illustrated in FIG. 1, constituted by a cylindrical heating element 2' for heat generation, a metal electrode 13 fixedly mounted on a stationary plate 14 through an insulator 5, and a number cylindrical posts 6' serving as electrode rods and secured to the heating element 2' by threaded engagement of screw portions 7' at the upper ends of the posts 6' with tapped holes 16 formed in the lower end of the heating element 2' for connecting the metal electrode 13 to the heating element 2'. The heater construction with a heating element 2' connected to a cylindrical posts 6' in this manner permits facilitated centering when assembling the respective parts owing to the small Young's modulus of the flexible graphite heating element 2', which instead has a drawback in that it easily breaks due to fragility of the material and thus requires careful handling. Further, when part of the heating element 2' is broken or damaged, it becomes necessary to remove it along with the cylindrical posts 6' at the time of replacement with a fresh heating element, resulting in low working efficiency.

In order to eliminate the foregoing problems or drawbacks, there has been proposed a heater construction as shown in FIG. 2, in which the heating element 2' is provided with through holes 5' in a flange portion at its lower end and fixedly secured to the cylindrical posts 6' by inserting screw members 7' of the cylindrical posts 6' through the holes 5' and tightening nuts 9 on the screw members 7'. This heater construction can eliminate the drawback of the heater of FIG. 1 but still has an inherent problem that the through holes 5' have to be located on the outer side of the outer periphery of the heating element 2' and at a space therefrom by increasing the radial dimension of the heater as indicated by letter A to provide an ample space around the nuts 9 to permit the same to be easily turned with a tool. It follows that the heater has a larger outside diameter as compared with a heater of the same inside diameter, necessitating providing a high pressure container of a larger inside diameter which is disadvantageous from the standpoint of compactness of the HIP apparatus.

The just-mentioned problem can be solved by reducing the width of the flange to provide the through holes 7' substantially in the same radial positions as the heat generating portions (hatched portions) of the heating element 2' as shown particularly in FIG. 3. Similarly to the heater construction of FIG. 2, it is still necessary to provide a free space around each nut 9 for threading the same onto the screw member 7' by providing notches or void portions ($\alpha$) in the heating element at positions corresponding to the respective cylindrical posts 6'. The provision of such void portions in the heating element is however undesirable because of the impairment of uniform heating function of the heater.

SUMMARY OF THE INVENTION

In view of the above-mentioned merits and demerits of the conventional heater constructions, the present invention has as its object the provision of a heater of compact construction which can solve the problems of stability in construction and uniform heating by employment of a heater assembly unit or units of reduced dimensions (particularly in thickness) to permit effective use of a limited space in a costly high pressure container of the HIP apparatus.

According to a fundamental aspect of the present invention, there is provided a heater for use in a HIP apparatus for treating a work item or work items in a high temperature and pressure gas atmosphere by isostatic application of pressure in a heated condition, the heater comprising at least one heater assembly unit including:

a sinuous heating element arranged in a cylindrical grid-like form having axial slits open alternatively at the upper and lower ends thereof;

a plurality number of radial projections of a predetermined width extending radially outward from the upper ends of the sinuous heating element at a number of predetermined positions including terminal ends thereof;

a number of mounted holes formed through the radial extensions of the heating element;

a number of support columns fixedly erected respectively on retaining members and having a male screw portion at the upper ends thereof respectively protruded upwardly through the mounting holes in the radial extensions of the heating element; and a number of nuts respectively threaded and tightened on the protruded ends of the male screw portions of the support columns to thereby support in a suspended state the heating element securely on the support columns, forming a cylindrical space therein.

In a preferred form of the invention, the heater assembly unit is enclosed in a multi-layered cylindrical heat insulator consisting alternately of an unperforated flexible graphite sheet and a perforated flexible graphite sheet.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 4:
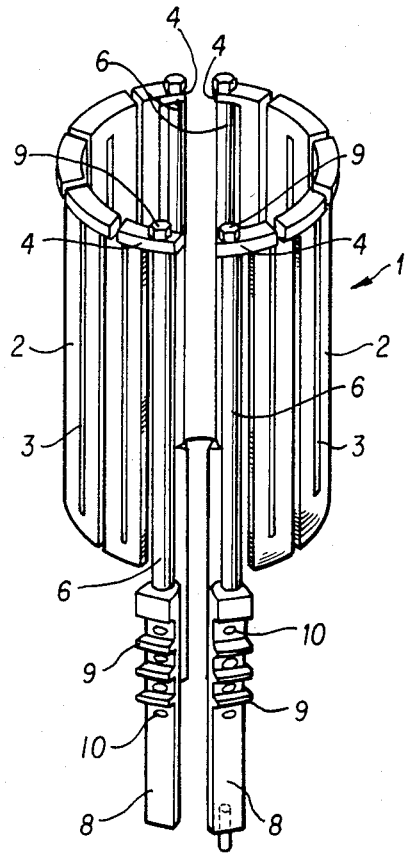
FIG. 4 is a schematic perspective view of a heater unit according to the present invention.

Referring to the accompanying drawings and first to FIG. 4, there is illustrated in a perspective view major component parts of a heater assembly unit 1 of the heater according to the present invention, which is intended for use in an HIP apparatus. The heater assembly unit 1 defines a cylindrical space on the inner side and is constituted by a pair of sinuous heating elements 2 of grid-like semi-cylindrical shape each containing a number of axial slits 3 which are open alternately at the lower and upper ends thereof.

A number of radial projections 4 are provided at suitable positions around the upper end of each heating element 2 including terminal end positions thereof, the radial projections 4 extending radially outward of the heating element 2 and having axial mounting holes 5 in terminal end projections 4. Each one of the heating elements 2 is supported in a suspended state on a pair of cylindrical columns 6 which engage the afore-mentioned mounting holes 5.

Figure 5:
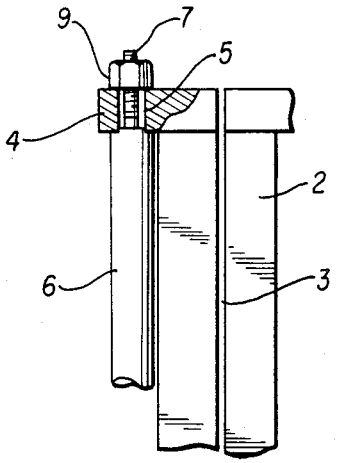
FIG. 5 is a schematic section showing on an enlarged scale the main component parts of the heater of FIG. 4.

The support columns 6 consist of a round rod which has a diameter greater than that of the axial mounting holes 5, and, as shown particularly in FIG. 5, are provided with a narrow male screw portion 7 over a suitable length at the respective upper ends, which male screw portions are inserted in the mounting holes 5 in the terminal end projections 4. Nuts 9 are tightly threaded on the upper end of the male screw portions which are projected above the mounting holes 5 thereby securely fixing the support columns 6 to the terminal radial projections 4.

The respective support columns 6 are fixedly erected on retainers 8 of a metal such as copper or molybdenum, which are alternately provided with a fin 9 for shielding radiation heat and a hole 10 for suppressing heat conduction in the longitudinal direction. In the particular example shown, the heating power is applied to the heating elements 2 through the respective retainers 8 and support columns 6 which serve as electrode rods.

Although a cylindrical heating body 1 is constituted by a pair of semi-cylindrical heating elements 2 in the embodiment shown in FIG. 4, it may be divided into three or four or more segmental heating elements 2 if desired. Further, instead of the semi-cylindrical or arcuate heating elements 2 which constitute segments of a cylinder, the heating assembly 1 may be formed of a plurality of heating elements of flat strips which are arranged substantially in a cylindrical form.

Figure 6:
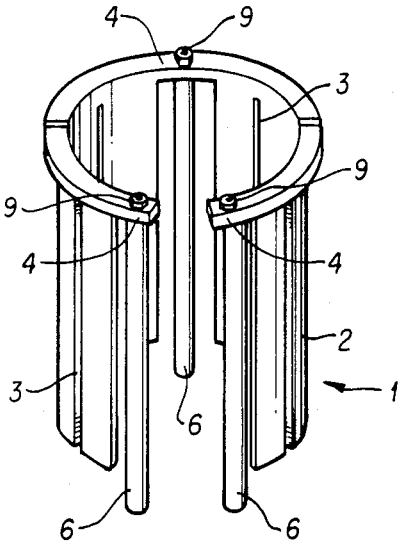
FIG. 6 is a schematic perspective view of another heater unit according to the present invention.

Referring to FIG. 6, there is shown another embodiment of the present invention, in which the heating element 2 has a cylindrical body of graphite which is discontinued at one circumferential portion by an axially opening and provided with radial projections 4 at the upper ends of the sinuous heating element arranged in cylindrical form similarly to the embodiment of FIG. 4, namely with three radial projections 4 each formed with a mounting hole 5. Thus, in this case, the heater unit 1 is constituted by a single heating element 2 which is supported in a suspended state on three support columns 6 of graphite.

The heating element 2 is securely fixed to the support columns 6 by nuts 9 in the same manner as in the foregoing embodiment. The heating power may be supplied either by applying a voltage across the terminal support columns 6 or by connecting the heating element portions on opposite sides of the intermediate support column 6 in parallel to an electrode (not shown) which is provided in a lower position.

Figure 7:
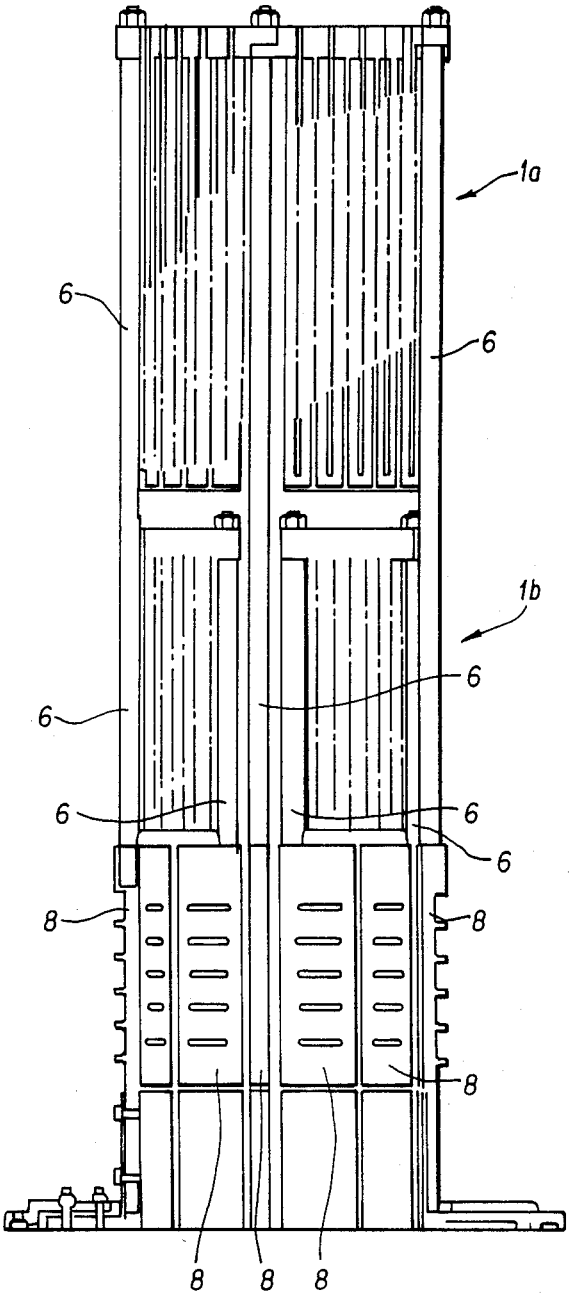
FIG. 7 is a schematic front view of a heater embodying the present invention.

FIG. 7 shows an example of the heater which employs the heater units 1 of the above-described construction, more specifically, the heater units 1 of FIGS. 4 and 5 which are stacked one on the other to provide upper and lower heating zones 1*a* and 1*b* which are energizable independently of each other.

Since a gap of a suitable width can be formed vertically between the terminal support columns 6 of the upper heating body 1*a*, extending vertically through the lower heating body 1*b*, it is possible to provide temperature measuring elements such as thermocouples at vertically spaced positions in the gap to control the power supply to the upper and lower heating bodies 1*a* and 1*b* independently of each other according to the values detected by the respective temperature measuring elements.

Figure 8:
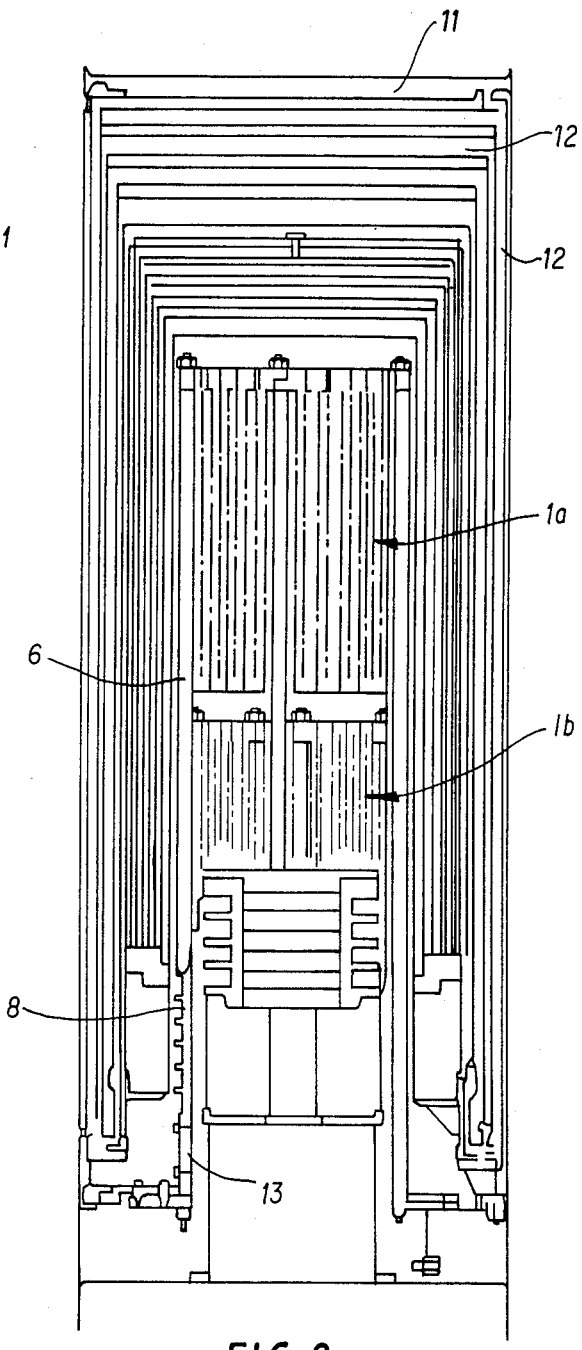
FIG. 8 is a schematic view of a high pressure chamber of a HIP apparatus incorporating a heater according to the present invention.

Now, reference is had to FIG. 8 showing the heater of the present invention which is accommodated in a high pressure container 11 of an HIP apparatus. The heater in the high pressure container is of the same construction as in FIG. 7 and enclosed a multi-layered heat insulator 12 of an inverted cup-like shape which is also accommodated in the container 11.

Similarly to the embodiment of FIG. 4, retaining members 8 which are provided with fins 9 and holes 10 are located in the lower portion of the heater, more specifically, beneath the support columns 6, the lower end of the retaining member being fixedly secured to a copper electrode 13 which is electrically insulated from the high pressure container 11.

In the case of a furnace which is used in a high pressure gas atmosphere, especially, under a pressure higher than 100 kgf/cm, the heater of the above-described construction is accommodated in the high pressure container along with the heat insulating structure to maintain the temperature of the container itself at a level below 100° C. for preventing deteriorations in the strength of the material of the high pressure container.

On the other hand, in order to minimize the gas energy in the high pressure container as much as possible for safe operation, it is preferred to reduce the inner volume of the high pressure container as compared with the volume of the work. To this end, the heat insulating structure and heater should be designed with compact construction. To particularly ensure uniform heating in a furnace under a pressure higher than 300 kgf/cm with vigorous free convection, the heater is required to be able to control independently the heat generation of each one of the stacked heating bodies. However, it has been considered difficult to fabricate a graphite type heater of compact construction.

Figure 1:
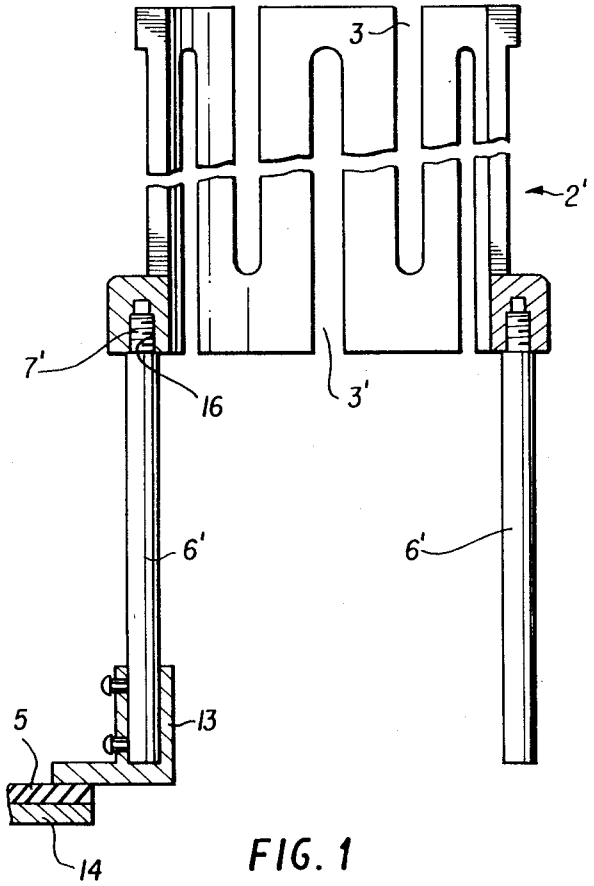
FIG. 1 PRIOR ART
FIGS. 1 and 2 are sectioned front views of conventional heaters.
Figure 2:
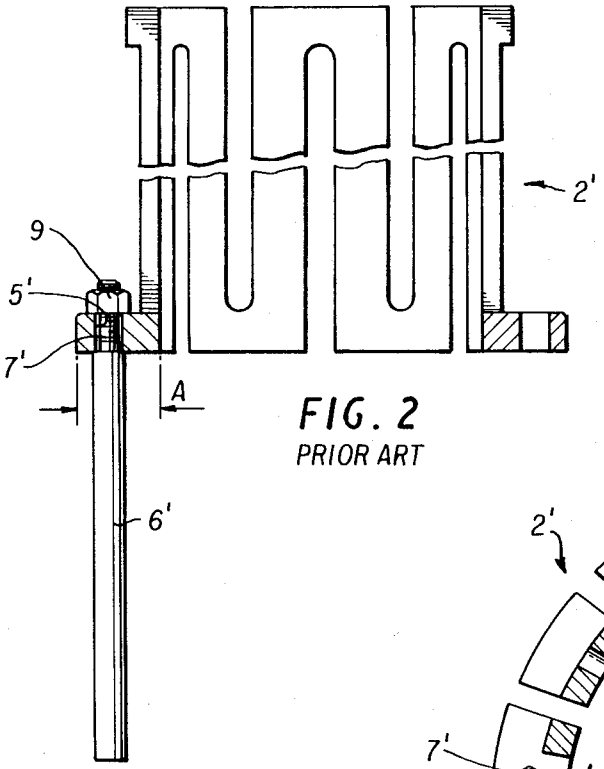
FIG. 2 PRIOR ART
Figure 3:
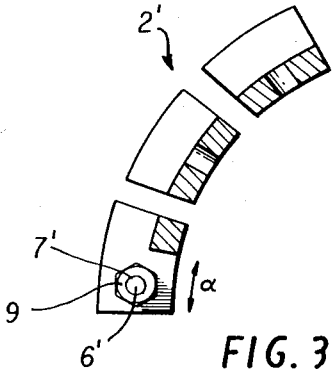
FIG. 3 PRIOR ART
FIG. 3 is a fragmentary plan view of the heater of FIG. 2.

It will be clear from the foregoing description that the heater can be assembled securely simply by tightening the nuts 9 with the respective heating elements 2 in suspended state on the support columns 6 of graphite which are fixed on the lower retaining members 8 and electrode. The nuts 9 can be threaded and tightened efficiently since they are positioned on top of the heating elements 2 with no obstacle around the respective nuts. The tapped holes 5 are formed in positions close to the heat generating portions of the heating elements 2 in the circumferential direction, so that the support columns 6 can be located almost in alignment with the heating elements 2 without bulging radially outward to provide a compact heater construction. The length ($\alpha$) of the terminal extension shown in FIG. 3, which does not contribute to heat generation, can be formed as small as possible to ensure a uniform heating effect.

The thickness of the support columns 6 can be determined without being restricted by the size and thickness of the heating elements 2 to fabricate a heater of rigid construction. As the support columns 6 are located to bulge radially outward, a number of heater units 1 can be stacked one on another in an extremely narrow restricted space, permitting supplying of suitable power independently to the respective heater units 1 to maintain uniform temperature distribution in the vertical direction. The heater construction of the invention employs graphite for the component parts which are located in the high temperature zone above the retaining members 8, so that it can ensure stable heating operation at temperatures above 2000° C. in contrast to the conventional stacked heater construction in which an insulating material like boron nitride is interposed between the stacked upper and lower heater units.

In addition to the compact construction of the heater, the heat insulating wall is preferably formed in as small a thickness as possible for effective use of the limited space in the high pressure container, without entailing degradations in its heat insulating ability.

Figure 9:
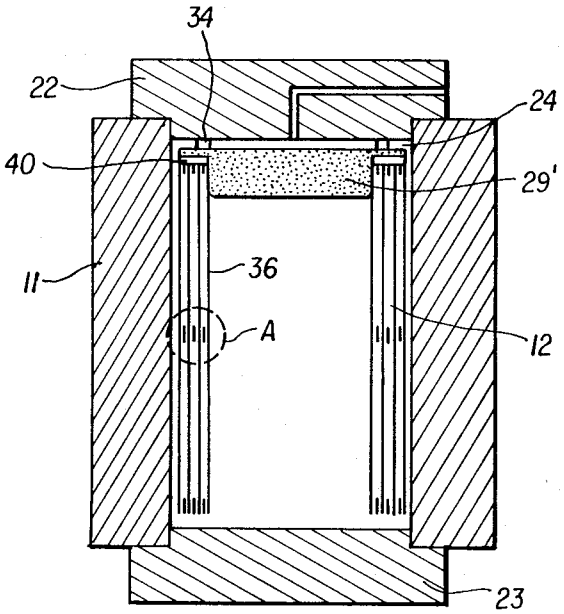
FIG. 9 is a schematic vertical section of a high pressure chamber incorporating a multi-layered heat insulator according to the invention.
Figure 10:
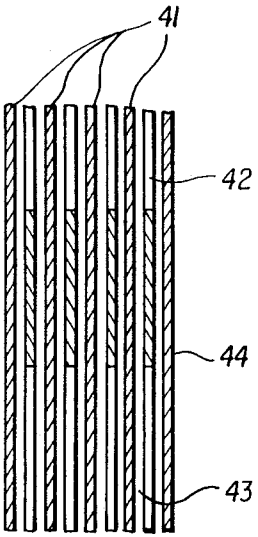
FIG. 10 is an enlarged view of the portion indicated by letter A in FIG. 9.

FIGS. 9 and 10 illustrate in greater detail the multi-layered heat insulator 12 employed in the present invention. The heat insulator has a multi-layered cylindrical body 36 which is constituted alternately by a flexible graphite sheet 41 and a perforated flexible graphite sheet 42 which are spaced from each other by a narrow gap 43.

Figure 11:
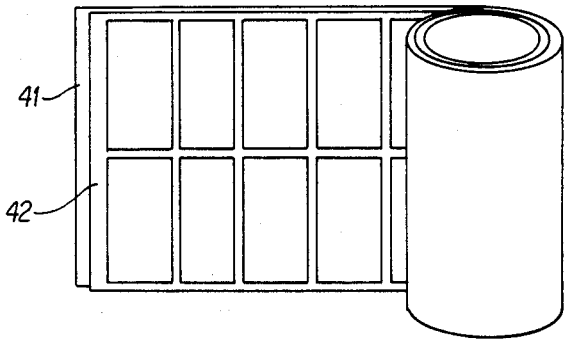
FIGS. 11 and 12 are schematic illustrations of perforated flexible graphite sheets.
Figure 12:
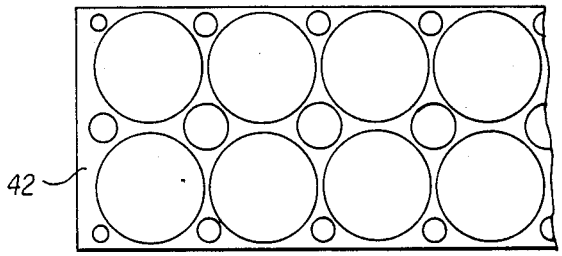

The perforations in the graphite sheet 43 which constitutes a layer alternately with unperforated flexible graphite sheets 42 are preferably formed uniformly over the entire areas of the graphite sheets 43, but may be of circular or polygonal shape or may be a combination of small and large perforations as shown in FIGS. 11 and 12. However, it is to be noted that the perforations should be formed in a suitable areal ratio as it is closely related with the heat insulating effect by the gaps formed between the respective graphite sheet layers of the heat insulator.

Figure 13:
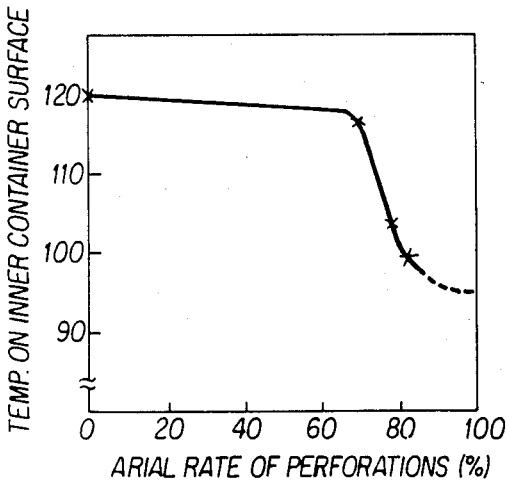
FIG. 13 is a graph showing the heat insulating effect of the heat insulator in relation with the areal rate of the perforations.

In this connection, as a result of analysis of experimental data obtained from insulators using graphite sheets containing perforations in different areal ratios, it has been confirmed that it should be in the range of 70–95%. More specifically, FIG. 13 which shows the areal ratio of the perforations in relation to the temperature on the inner surface of the high pressure container in experiments under the conditions where the furnace temperature was 1900° C., the pressure in the container was 2000 kg/cm$^2$ and the ambient temperature was 30° C. As seen therefrom, the temperature on the inner surface of the container was 120° C. when the areal ratio of perforation was zero, that is to say, when the graphite sheet contained no perforations, but it dropped conspicuously as the areal ratio of perforations in alternate graphite sheet layers became greater than about 70%, and to 100° C. at an areal ratio of about 80%.

Although the experimental data indicate that the areal ratio of perforations should be as great as possible, it is limited to about 95% in consideration of the difficulty of forming perforations in the graphite sheets of a thickness of 0.1–1.0 mm, and preferably to be in the range of 70–95%.

The most simple method of forming a cylindrical body of the insulator which alternately consists of an unperforated flexible graphite sheet and a perforated flexible graphite sheet is to wind elongated strips of unperforated and perforated graphite sheets in an overlapped state.

However, in the situation where it is required to wind the graphite sheets into a regular cylindrical shape or to increase the mechanical strength of the cylindrical body, the overlapped flexible graphite sheet may be spirally wound around a cylindrical core which is made of graphite or a composite material of carbon-carbon fibre.

The cylindrical insulator body which is obtained by overlapping and winding flexible graphite sheets in this manner has an advantage in that a cylindrical heat insulating body with a large axial length can be formed without being limited by the width of the flexible graphite sheets. In addition, the cylindrical body shape thus formed can be retained simply by binding up its outer periphery with trusses of carbon fibre.

Of course, the cylindrical body may be employed to constitute the whole heat insulating layers of the heat insulator or may be incorporated into part of the heat insulator. Alternatively, the coaxially disposed cylindrical layers may be radially divided into a number of sectors, or a number of cylindrical bodies may be stacked one on another to form heat insulating layers of a cylindrical or inverted cup-like form.

For forming perforations in the flexible graphite sheets, there can be employed a suitable perforating means such as punching, cutting and the like, depending upon the shpae of the perforations to be formed. In order to form perforations in a single elongated graphite sheet prior to coiling, a multitude of perforations are formed at intervals of $\pi D$ (in which D is the diameter at the outermost surface of the cylindrical body). (See FIGS. 11 and 12).

Although the foregoing description concerns cylindrical heat insulating layers which communicate with the high pressure chamber at the upper and lower ends thereof, the upper end of the cylindrical body is closed with an upper lid to provide heat insulating layers of an inverted cup-like shape. In such a case, it is preferred that the upper lid is also constituted by heat insulating layers which consist alternately of an unperforated and a perforated flexible graphite sheet similarly to the cylindrical body.

Thus, the respective layers of graphite sheets are spaced from one another by a predetermined gap which is maintained by the alternately disposed perforated graphite sheet and filled with a pressurizing gas medium like Ar gas. Normally, in spite of its extreme heat capacity, Ar gas which has a very small viscosity causes a large amount of heat transmission due to convection, so that the heat insulating layers should have a construction which can sufficiently suppress the heat dissipation by radiation as well as by the convection heat transmission.

The thermal conductivity of high pressure Ar gas itself is, however, extremely small, for example, as small as 1/60 of $1.24\times10^{-4}$ cal/cm.sec °C. under the condition of 1000 kg/cm$^2$ and 400° C. Therefore, the high pressure Ar gas which is confined with no convection in narrow gaps between the respective heat insulating layers is extremely effective for enhancing the heat insulation by the layers of the graphite sheets.

The heat transmission by convention of Ar gas in the gaps between the graphite sheets is determined by the width of the gaps, the temperature difference between the inner and outer sheets, the physical properties of Ar gas such as thermal conductivity, thermal expansion coefficient, density, viscosity and the like. However, since the convection can be substantially suppressed by holding the gap width below a certain value with respect to a given pressure and a temperature difference between the inner and outer sheets, the heat transmission across the space between the inner and outer sheets is determined by thermal conduction of Ar gas and radiant heat alone. The heat insulating layers of the present invention, containing gaps corresponding to the sheet thickness which is smaller than 1 mm between the respective graphite sheet layers, thus can ensure sufficient heat insulation.

In some cases, the heat insulation by the cylindrical body which is open at the upper and lower ends of the spirally wound alternate layers of perforated and unperforated flexible graphite sheets is lowered by upward Ar gas flow through the gaps between the graphite sheet layers, increasing the temperature at the upper end of the cylindrical heat insulating body or in the upper portion of the high pressure container. This problem can be avoided effectively by hermetically closing the upper or lower end of the cylindrical body by a seal ring or other seal means.

Although the thermal conductivity of the heat insulating layers in a HIP system is generally complicatedly influenced by the thermal conduction of the sheet material, heat radiation between the sheet layers and convection of the pressurizing gas medium as mentioned hereinbefore, the heat insulating layers of the construction shown in FIGS. 9 and 10 are capable of suppressing such heat transmission to a sufficient degree.

Namely, with regard to the heat conduction, the thermal conductivity of the flexible graphite sheet across its thickness is very small as compared with ordinary graphite material, more particularly, as small as 0.00872 cal/cm.sec°C., so that the heat dissipation across the overlapped sheet portion 44 of FIG. 10 is extremely small. On the other hand, the heat radiation can be suppressed effectively by forming the multiple heat insulating layers by overlapping the flexible graphite sheets which have a radiation rate smaller than 0.6 at a high temperature of about 1700° C.

With regard to free convection of the pressurizing gas medium, it can be suppressed almost completely by the provision of extremely narrow gaps 43 with a width of 0.1–1.0 mm, minimizing the heat dissipation to an amount comparable to that which is attributable to the heat conduction of the pressurizing gas medium.

The above-described multi-layered heat insulator construction has further advantages accruing from the extremely small thermal expansion coefficient of the flexible graphite sheets in the surfacewise directions, which is about $1\times10^{-6}$/°C., in addition to the small friction coefficient. Namely, it is free of deformations which would otherwise be caused by a temperature difference between the innermost and outermost portions of the cylindrical heat insulating layers 36, and the overlapped layers are permitted to slip one on another to prevent deformations of the heat insulator as a whole.

The above-described effects are derived from the cylindrical body which consists of multiple layers of flexible graphite sheets, and which is easy to handle and free of the large heat losses as would be caused when the heat insulating structure incorporates nets of heat resistance wire or the like. Further, the heat insulator has a stable and long service life in contrast to a heat insulating material like ceramic fibre which suffers from deteriorations by aging due to crystallization of the material.

If desired, the cylindrical body of the heat insulator may be constituted by three or more separable coaxial cylindrical blocks each similarly consisting of alternate layers of unperforated and perforated flexible graphite sheets to thereby further minimize the deformation due to the temperature difference between the inner and outer portions of the cylindrical body. In such a case, the inner block or blocks may be omitted in an operation at a lower temperature for increasing the cooling speed in a subsequent cooling stage to shorten the cycle time of the HIP operation.

Further, the heat insulator may be constituted by a couple of cylindrical bodies of the above-described construction which are stacked one on the other through a graphite ring. In this instance, the gaps between the individual heat insulating layers of the stacked upper and lower cylindrical bodies are communicated with the high pressure chamber at the upper and lower ends, respectively, to prevent damage of the heat insulating layers at the time of pressurizing and depressurizing the HIP chamber.

Obviously, numerous modifications and variations of the present invention are possible in light of the above teachings. It is therefore to be understood that within the scope of the appended claims, the invention may be practiced otherwise than as specifically described herein.

What is claimed as new and is intended to be secured by Letters Patent is:

1. A heater assembly unit for use in HIP apparatus for treating at least one work item in a high temperature and high pressure gas atmosphere by isostatic application of pressure, said heater assembly unit comprising:

(a) two axially vertically disposed sinuous graphite heating elements each of which is composed of a plurality of longitudinal segments disposed in an array which is a portion of a cylinder in shape, each of said longitudinal segments extending the axial length of said heating element, being connected to the adjacent longitudinal segment on one side at the top of said heating element and to the adjacent longitudinal segment on the other side at the bottom of said heating element by a circumferential segment of the graphite heating element, and being spaced from both adjacent longitudinal segments along the axial length thereof, whereby each of said heating elements is one continuous piece of graphite in grid-like form having axial slits therein which are open alternately at their upper and lower ends and which are closed at their opposite ends by one of said circumferential segments;

(b) a plurality of terminal end portions extending radially outwardly from the upper end of each of said graphite heating elements and being part of a circumferentially extending radial projection, each of said terminal end portions having a vertically disposed mounting hole therethrough;

(c) a pair of metallic retaining members having fins thereon for shielding radiation heat and holes therein for suppressing heat conduction;

(d) a vertically oriented support column fixedly erected on each of said metallic retaining members, each of said vertically oriented support columns having an upwardly disposed abutment surface which abuts the underside of one of said terminal end portions and a male screw portion at its upper end which protrudes through the mounting hole in said one of said terminal end portions, said support column serving as means for supplying electric power to said heating elements; and (e) securing means threaded onto the male screw portions of said support columns so as to abuttingly engage the upper surfaces of said terminal end portions.

2. A heater assembly as recited in claim 1 wherein a plurality of said graphite heating elements are stacked on one another to form a plurality of independently controlled heating zones.

3. A heater assembly as recited in claim 1 wherein said segments are curved strips the radially inner and outer surfaces of which lie on concentric semi-circles.

4. A heater assembly as recited in claim 1 wherein said metallic retaining members are made of copper.

5. A heater assembly as recited in claim 1 wherein said metallic retaining members are made of molybdenum.

6. A heater assembly as recited in claim 1 wherein said longitudinal segments are semi-cylindrical in shape.

* * * * *